US005777527A

United States Patent [19]

Sanders

[11] Patent Number: 5,777,527

[45] Date of Patent: Jul. 7, 1998

[54] METHOD AND APPARATUS FOR COUPLING A DIFFERENTIAL SIGNAL TO AN UNBALANCED PORT

[75] Inventor: Stuart B. Sanders, Lindenhurst, Ill.

[73] Assignee: Motorola, Inc., Schaumburg, Ill.

[21] Appl. No.: 742,069

[22] Filed: Oct. 31, 1996

[51] Int. Cl.[6] ..... H01P 5/10

[52] U.S. Cl. ..... 333/26; 333/116

[58] Field of Search ..... 333/25, 26, 116, 333/109

[56] References Cited

U.S. PATENT DOCUMENTS

| | | | |
|---|---|---|---|
| 2,478,313 | 8/1949 | Peterson | 333/26 X |
| 3,500,259 | 3/1970 | Seidel | 333/109 X |
| 3,976,959 | 8/1976 | Gaspari | 333/26 |
| 4,193,048 | 3/1980 | Nyhus | 333/26 |
| 4,460,877 | 7/1984 | Sterns | 333/26 |
| 4,725,792 | 2/1988 | Lampe, Jr. | 333/26 |
| 5,061,910 | 10/1991 | Boung | 333/26 |
| 5,148,130 | 9/1992 | Dietrich | 333/25 |
| 5,376,904 | 12/1994 | Wong | 333/109 |
| 5,455,545 | 10/1995 | Garcia | 333/26 |
| 5,523,728 | 6/1996 | McCorkle | 333/128 |

FOREIGN PATENT DOCUMENTS

| | | | |
|---|---|---|---|
| 54-148405 | 8/1984 | Japan | 333/26 |

*Primary Examiner*—Paul Gensler
*Attorney, Agent, or Firm*—Charles D. Gavrilovich, Jr.

[57] ABSTRACT

A differential signal is coupled to an unbalanced port (116) from a balanced port (110) by receiving a first portion of a first phase of a differential signal at a first resonator (104) and receiving a second phase of the differential signal at a second resonator (108). The first portion of the first phase of the differential signal is coupled to a first matching element (112) and the second phase of the differential signal is coupled to a second matching element (118). The first portion of the first phase of the differential signal is coupled to a phasing element (122) through the first matching element (112) and a second portion of the first phase of the differential signal, which is a 180 degree out of representation of the second phase of the differential signal, is coupled to the phasing element (122) through the second matching element (118). The first portion of the first phase of the differential signal and the second portion of the first phase of the differential signal are combined in the phasing element (122) to produce an unbalanced signal at the unbalanced port (116).

18 Claims, 2 Drawing Sheets

METHOD AND APPARATUS FOR COUPLING A DIFFERENTIAL SIGNAL TO AN UNBALANCED PORT

BACKGROUND

The present invention relates, in general, to transformers and more particularly to baluns.

A balun is an electrical transformer used for coupling a balanced line to an unbalanced line. Some applications of baluns also require matching a high impedance of the balanced line to a lower impedance of the unbalanced line. A balanced line is composed of two separate conductors also referred to as lines. The voltage with respect to ground of each of the two lines are equal in magnitude but opposite in phase. In an unbalanced line, one of the two lines is at ground potential.

Conventional balun designs include tuned wire-wound transformers with the proper wire turns ratio. However, these designs are limited at frequencies above 300 MHz. Above this frequency, conventional baluns fail to have their desired effects because the self inductance of even a small single turn loop resonates with stray capacitance below the desired frequency. Other limiting factors include small permissible impedance ratios due to a low number of usable turns, low Q (Quality-factor) of small diameter wire and wide tolerances due to parasitic capacitance and inductance. In addition, implementations of wire-wound transformers are typically large.

Other conventional designs include coaxial baluns in which the unbalanced line is connected to the center conductor of a coaxial transmission line with outer conductor grounded at the input and the balanced output is connected at the opposite end of the coaxial transmission line. However, these deigns are limited in that implementations only allow for small impedance transformations. In other words, the impedance at one port of the balun must be comparable in magnitude to the impedance at the second port of the balun.

Attempts to reduce the size of a balun include microstrip and stripline solutions. However, these solutions are limited in that implementations are complicated and their performance is sensitive to material variations.

Various electrical circuits using baluns require frequency selectivity. One example in which frequency selectivity is desirable is the use of a balun to couple a fixed frequency Gilbert cell mixer to an amplifier stage. Allowing only the fixed frequency output of the Gilbert cell mixer to pass to the amplifier stage helps maintain a high signal to noise ratio and linear operation of the amplifier stage among other advantages.

Conventional microstrip and stripline baluns do not provide frequency selectivity while maintaining low loss, small design and a broad tolerance for material variations.

Therefore, there exists a need for a balun device that is small, easy to manufacture, frequency selective, and has tolerances o wide variations in materials without a degradation in performance.

DETAILED DESCRIPTION OF THE DRAWINGS

The present invention provides a method and apparatus for coupling a differential signal to an unbalanced port.

In the preferred embodiment of the invention a balun is implemented using microstrip technology resulting in an apparatus that is easy to manufacture and small. The unique design results in a balun that is frequency selective and has tolerances to material variations.

Figure 1:
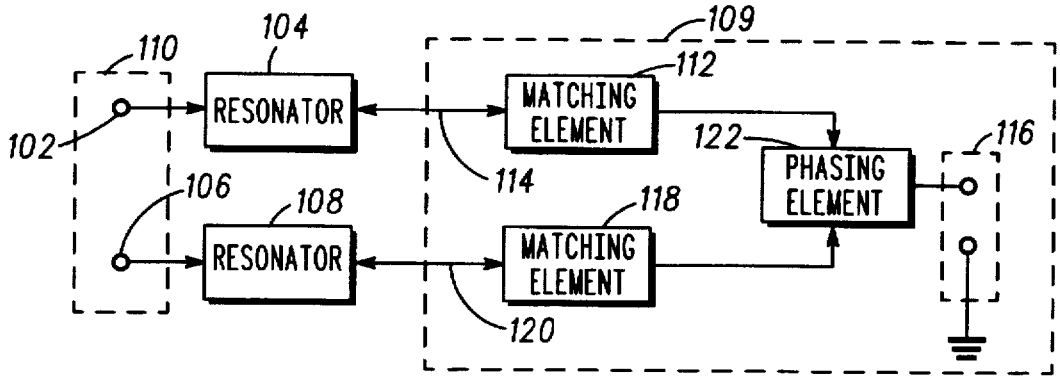
FIG. 1 is a block diagram in accordance with the preferred embodiment of the present invention.

A block diagram of the preferred embodiment of the present invention is shown in FIG. 1. A differential signal is received at a balanced port 110. A first portion of the differential signal is coupled through the first resonator 104 and second portion is coupled through the second resonator 108. Each portion of the differential signal is coupled from the resonators (104, 108) through the respective matching elements (112, 118) to the phase combiner 109. The signals are coupled to the phasing element 122 and are combined in the phasing element 122 such that they constructively add and produce a single-ended signal at the unbalanced port 116.

A first resonator port 102 of a first resonator 104 and a second resonator port 106 of a second resonator 108 define a balanced port 110. The balanced port 110 is capable of receiving a differential signal, typically, from a high impedance source. A first phase of the differential signal is received through the first resonator port 102 and a second phase of the differential signal is received through the second resonator port 106. The second phase of the differential signal is 180 degrees out of phase with the first phase of the differential signal.

Each resonator (104, 108) is preferably constructed from a length of transmission line as is discussed below. As is known, resonators are constructed to have a particular resonant frequency. Signals having frequencies at or near the resonant frequency have higher amplitudes within the resonator than signals having frequencies farther from the resonant frequencies. Preferably, the resonant frequency of the first resonator 104 (first resonant frequency) is equal to the resonant frequency of the second resonator 108 (second resonant frequency). The first and second resonant frequencies are chosen to be the center of a bandwidth of the differential signal.

The first resonator is coupled to a first matching element 112, preferably, through a microwave coupler 114. The first phase of the differential signal is electrically coupled through the first microwave coupler 114 to the first matching element 112. Preferably, the first matching element 112 has a characteristic impedance that is equal to twice the impedance of a unbalanced port 116.

The second resonator 108 is electrically coupled to the second matching element 118 through a second microwave coupler 120. The second phase of the differential signal is coupled through the second microwave coupler 120 to the second matching element 118. Preferably, the second matching element 118 has a characteristic impedance equal to twice the impedance of the unbalanced port 116.

A phasing element 122 is electrically coupled to the first matching element 112 such that the first phase of the differential signal is coupled to the phasing element 122. The first phase of the differential signal that is coupled through the first matching element 112 is referred to as the first portion of the first phase of the differential signal.

The phasing element 122 is electrically coupled to the second matching element 118 such that a signal that is a 180 degree phase shifted representation of the second phase of the differential signal is coupled to the phasing element 122. Since the signal coupled from the second matching element 118 to the phasing element 122 is 180 degrees out of phase with the second phase of the differential signal, the signal is in phase with the first phase of the differential signal.

The signal coupled from the second matching element 118 to the phasing element 122 is referred to as the second portion of the first phase of the differential signal.

The first portion of the first phase of the differential signal and the second portion of the first phase of the differential signal are combined in the phasing element 122. These two signals constructively add to produce an unbalanced signal at the unbalanced port 116.

Since the first and second matching elements (112, 118) are coupled in parallel and have the same impedance, the impedance at the phasing element 122 is equal to half of their impedance. As explained above, the impedance of the matching elements (112, 118) is chosen to be twice the desired impedance of the unbalanced port 116. Therefore, the impedance resulting from the two matching elements (112, 118) combined in parallel is equal to the impedance of the unbalanced port 116.

The bandwidth of the unbalanced port 116 is centered around the resonant frequency of the resonators (104, 108) and may also be dependent on the particular implementation of the resonators (104, 108), the matching elements (112, 118), the microwave couplers (114, 120) and the phasing element 122.

Therefore, a differential signal, produced in a high impedance source, is coupled across the first and second resonator ports (102, 106) and a single ended signal is produced at the unbalanced port 116 which can be coupled to a relatively low impedance unbalanced load.

Figure 2:
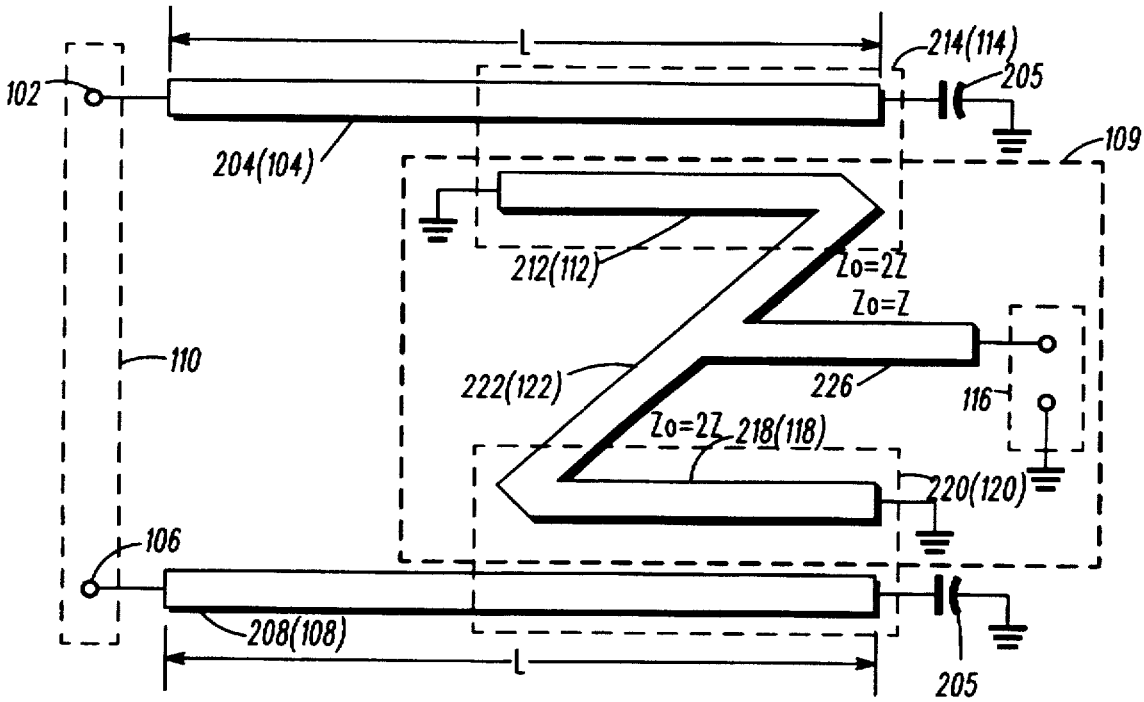
FIG. 2 is a schematic representation according to a microstrip implementation of the present invention.

A schematic diagram according to a microstrip implementation of the preferred embodiment of the invention is shown in FIG. 2. Preferably, the resonators (104, 108), the matching elements (112, 118), and the phasing element 122 are implemented by depositing metal traces on the first side of a dielectric substrate using microstrip technology. A continuous ground plane is deposited on the second side of the substrate. It is understood that each element implemented in microstrip may be constructed using other technologies such as stripline.

The resonator 104 is constructed using a length of microstrip transmission line on the first side of the substrate resulting in a first microstrip resonant line 204 (first transmission line resonator). Using known techniques, the first microstrip resonant line 204 and the second microstrip resonant line 208 (second transmission line resonator) are quarter wave resonators designed to be resonant at the frequency of the differential signal (also the frequency at the center of the bandwidth of the unbalanced port). Preferably, the length of the first microstrip resonant line and the second microstrip resonant line (indicated by "L" in FIG. 2) is chosen to be a quarter wave length of the frequency of the differential signal for the particular substrate. The capacitors 205 create a short circuit to ground at the resonant frequency. It is observed that any odd multiple of the quarter wave length and a radio frequency (RF) short to ground may be used to create the microstrip resonant lines (204, 208). Alternatively, the microstrip resonant lines (204, 208) may be halfwave resonators constructed using odd multiple halfwave lengths of transmission lines open at one end.

A first microstrip matching line 212 (first matching transmission line) is constructed such that a first microstrip coupler 214 (first microwave coupler 114) is formed between the first microstrip matching line 212 and the first microstrip resonant line 204. The first microstrip matching line 212 has a ground end that is connected to ground potential and a connection end connected to a microstrip phasing line (phasing transmission line) 222. As is known, the impedance at the connection end of the first microstrip matching line 212 and the phase of the differential signal at the connection end is dependent on the distance between the first microstrip matching line 212 and the first microstrip resonant line 204, the dielectric of the substrate, the length of the first microstrip matching line 212, the characteristic impedance of the first microstrip matching line 212 and the location of the connection end. Using known techniques, the first microstrip matching line 212 is constructed such that the impedance at the connection end is equal to twice the impedance of the unbalanced port 116 (Z) and the first phase of the differential signal is coupled to the microstrip phasing line 222.

The microstrip phasing line 222 has a first end and a second end separated by a length of phasing transmission line. The first end of the microstrip phasing line 222 is connected to the microstrip matching line 212. The microstrip phasing line 222 has a characteristic impedance (Zo) that is twice the impedance of the unbalanced port 116 (Z) and, therefore, equal to the impedance at the first microstrip matching line 212 (2Z).

The second end of the microstrip phasing line 222 is connected to a connection end of the second microstrip matching line (second matching transmission line) 218. The opposite end of the second microstrip matching line 218 is connected to ground potential. The microstrip matching line 218 is constructed to form a second microstrip coupler (second microwave coupler) 220 between the second microstrip resonant line 208 and the second microstrip matching line 218. The second microstrip matching line 218 is constructed such that the impedance at the connection end is twice the impedance of the unbalanced port 116 and therefore equal to the impedance of the first microstrip matching line 212.

The microstrip phasing line 222 is connected to the second microstrip matching 218 line such that the signal that is coupled from the matching line to the microstrip phasing line 222 is 180 degrees out of phase with the second phase of the differential signal.

Preferably, the first microstrip resonant line 204 is parallel to the second microstrip resonant line 208 and parallel to the microstrip matching lines (212, 218). The matching lines are located in the same positions with respect to the microstrip resonant lines (204, 208). The microstrip phasing line 222 is diagonally connected to the matching lines since the connection ends of the matching lines are located in opposite locations with respect to the microstrip resonant lines (204, 208). By connecting the microstrip phasing line 222 in this manner, the signal that is 180 degrees out of phase with the second phase of the differential signal is coupled to the microstrip phasing line 222. Since this signal is in phase with the first phase of the differential signal, it is a second portion of the first phase of the differential signal. The first portion and the second portion of the first phase of the differential signal combine on the microstrip phasing line by constructively adding at the midpoint of the microstrip phasing line 222. The midpoint is the distance from the first end or the second end of the microstrip phasing line 222 equal to half of the length of the phasing transmission line (half the length of the microstrip phasing line). An unbalanced signal is produced at the midpoint of the microstrip phasing line 222.

The unbalanced port 116 is connected to the microstrip phasing line 222 through a transmission line (unbalanced port transmission line) 226 having a characteristic impedance equal to the impedance of the unbalanced port 116. The unbalanced port transmission line 226 is connected to the microstrip phasing line 222 at the midpoint of the microstrip phasing line. The unbalanced port 116 may then be connected to a device, such as an amplifier stage, having the same impedance as the unbalanced port 116 with minimal loss.

Figure 3:
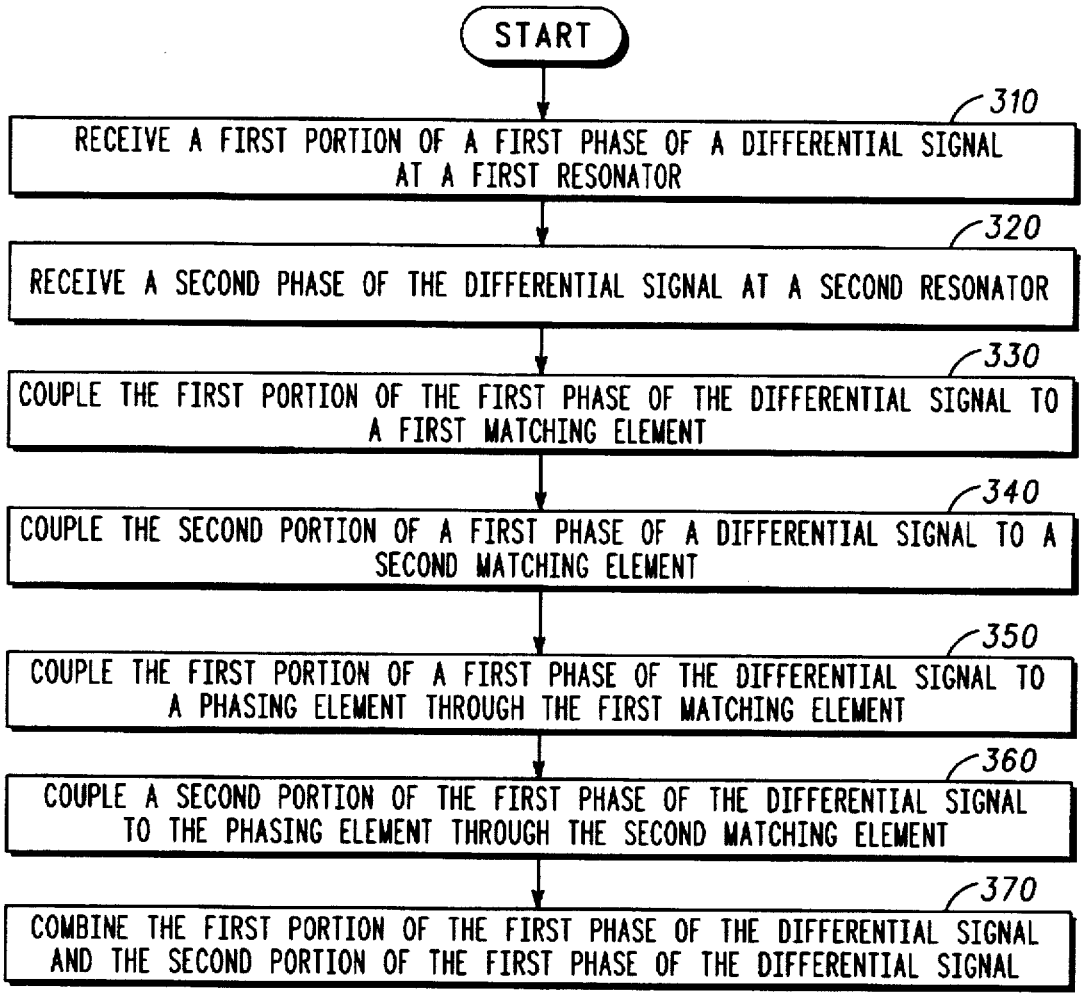
FIG. 3 is a flow chart of a method in accordance with the preferred embodiment of the present invention.

A flow chart of a method in accordance with preferred embodiment of the invention is shown in FIG. 3. At step 310, a first portion of a first phase of a differential signal is received at the first resonator 104 through the first resonator port 102. At step 320, a second phase of a differential signal, that is 180 degrees out of phase with the first phase of the differential signal, is received at the second resonator 108 through a second resonator port 106.

At step 330, the first portion of the first phase of the differential signal is coupled to the first matching element 112, preferably, through the microwave coupler 114. The second phase of the differential signal is coupled to the second matching element 118, preferably, through the microwave coupler 120, at step 340. At step 350, the first portion of the first phase of the differential signal is coupled to the phasing element 122.

At step 360, a signal which is 180 degrees out of phase with the second phase of the differential signal is coupled to the phasing element 122 through the second matching element 118. This signal is in phase with the first phase of the differential signal. Therefore, at step 360, a second portion of the first phase of the differential signal is coupled to the phasing element 122.

At step 370, the first portion of the first phase of the differential signal and the second portion of the first phase of the differential signal combine by constructively adding in the phasing element 122 to produce an unbalanced signal (single-ended signal) at the unbalanced port 116.

Therefore, a differential signal is connected across a balanced port 110 defined by first resonator port 102 and a second resonator port 106. The first resonator 104 and the second resonator 108 are designed to resonate at the frequency at the center of the bandwidth of the differential signal. A first portion of the first phase of the differential signal is coupled through a first microwave coupler 114 to a phasing element 122. The second portion of the first phase of the differential signal is coupled through a second microwave coupler 120 connected from the second resonator 108 by coupling a signal that is 180 degrees out of phase with the second phase of the differential signal. The first portion and the second portion of the first phase of the differential signal are combined in the phasing element 122 to produce a single ended signal at the unbalanced port 116.

Therefore, the present invention provides a method and device for efficiently matching a high impedance balanced port to a low impedance unbalanced port while providing frequency selectivity. In the preferred embodiment of the invention, a balun is implemented using microstrip technology resulting in an apparatus that is easy to manufacture and small. The unique design results in a balun that is frequency selective and has tolerances to material variations. Frequency selectivity is achieved with the use of resonators. Signals of different phases of a differential signal are combined such that the signals constructively add through the use of a uniquely shaped microstrip structure.

I claim:

1. An apparatus comprising:

a first resonator resonant at a frequency of a differential signal and having a first resonator port;

a first matching element coupled to the first resonator;

a phasing element coupled at a first phase of the differential signal to the first matching element, the phasing element having an unbalanced port;

a second matching element coupled at a second phase of the differential signal to the phasing element, the second matching element parallel to the first matching element; and a second resonator resonant at the frequency of the differential signal and a having a second resonator port, coupled to the second matching element, the first resonator port and the second resonator port forming a balanced port adapted to receive the differential signal, wherein the phasing element is coupled diagonally between the first matching element and the second matching element.

2. An apparatus according to claim 1, wherein the first phase of the differential signal is a 180 degrees out of phase with the second phase of the differential signal.

3. An apparatus in claim 1 wherein the first resonator comprises a first transmission line resonator.

4. An apparatus in claim 3 wherein the second resonator comprises a second transmission line resonator.

5. An apparatus according to claim 4, the first matching element comprising a first matching transmission line, wherein the first matching transmission line and first transmission line resonator define a first microwave coupler.

6. An apparatus according to claim 5, the second matching element comprising a second matching transmission line, wherein the second matching transmission line and second transmission line resonator define a second microwave coupler.

7. An apparatus according to claim 6, the phasing element comprising a phasing transmission line having a first end and a second end separated by a length of the phasing transmission line, the first end of the phasing transmission line electrically connected to the first transmission matching line and the second end of the phasing transmission line electrically connected to the second matching transmission line.

8. An apparatus according to claim 7, wherein the unbalanced port is connected to the phasing transmission line through an unbalanced port transmission line.

9. An apparatus according to claim 6, the unbalanced transmission line electrically connected to the phasing transmission line at a distance equal to a half of the length of the phasing transmission line from the first end of the phasing transmission line.

10. An apparatus according to claim 1, wherein the first resonator comprises a first microstrip resonant line.

11. An apparatus in claim 10 wherein the second resonator comprises a second microstrip resonant line.

12. An apparatus in claim 11 wherein the first matching element comprises a first microstrip matching line positioned to form a first microstrip coupler between the first microstrip resonant line and the first microstrip matching line.

13. An apparatus in claim 12 wherein the second matching element comprises a second microstrip matching line positioned to form a second microstrip coupler between the second microstrip resonant line and the second microstrip matching line.

14. An apparatus in claim 13 wherein the phasing element comprises a microstrip phasing line having a first end and a second end separated by a length of the microstrip phasing line, the first end of the microstrip phasing line electrically connected to the first matching line and the second end of the microstrip phasing line electrically connected to the second microstrip matching line.

15. An apparatus of claim 14 wherein the unbalanced port is connected to the microstrip phasing line through an unbalanced microstrip transmission line.

16. An apparatus according to claim 15, the unbalanced microstrip transmission line electrically connected to the microstrip phasing line at a distance equal to a half of the length of the microstrip phasing transmission line from the first end of the phasing transmission line.

17. A balun comprising:

a substrate having a first side and a second side;

a first microstrip resonant line, having a first resonator port and a resonant frequency, deposited on the first side of the substrate;

a first microstrip matching line deposited on the first side of the substrate coupled to the first microstrip resonant line through a microstrip coupler formed by the first microstrip resonant line and the first microstrip matching line;

a microstrip phasing line, deposited on the first side of the substrate, having a first end and a second end separated by a length of the microstrip phasing line, the first end of the microstrip phasing line electrically connected to the first microstrip matching line at a first phase of a differential signal;

a second microstrip matching line, deposited on the first side of the substrate parallel to the first microstrip matching line, the second microstrip matching line electrically connected to the second end of the microstrip phasing line at a second phase of the differential signal the second phase of the differential signal 180 degrees out of phase with the first phase of the differential signal;

a second microstrip resonant line, having a second resonator port and the resonant frequency, deposited on the first side of the substrate, coupled to the second microstrip matching line through a second microstrip coupler formed by the second microstrip resonant line and the second microstrip matching line, the first resonator port and the second resonator port defining a balanced port capable of receiving the differential signal; and an unbalanced microstrip transmission line, having a bandwidth limited by the resonant frequency, deposited on the first side of the substrate, electrically connected to the microstrip phasing line at a distance equal to a half of the length of the microstrip phasing line from the first end of the microstrip phasing line, wherein the microstrip phasing line is positioned diagonally in reference to the first microstrip matching line and the second microstrip matching line.

18. An apparatus comprising:

a first transmission line resonator resonant at a frequency of a differential signal and having a first resonator port;

a first matching transmission line coupled to the first transmission line resonator at a first phase of the differential signal;

a phasing transmission line having a first end and a second end separated by a length of the phasing transmission line, the first end of the phasing transmission line electrically connected to the first matching transmission line, the phasing transmission line having an unbalanced port;

a second matching transmission line electrically connected to the second end of the phasing transmission line and parallel to the first matching transmission line; and a second transmission line resonator resonant at the frequency of the differential signal and having a second resonator port, the second transmission line resonator coupled to the second matching transmission line at a second phase of the differential signal, the first resonator port and the second resonator port forming a balanced port capable of receiving the differential signal, wherein the phasing transmission line is positioned diagonally in reference to the first matching transmission line and the second matching transmission line.

* * * * *